US008292194B2

(12) United States Patent
Blechschmitt et al.

(10) Patent No.: US 8,292,194 B2
(45) **Date of Patent: *Oct. 23, 2012**

(54) PROCESS FOR MIXING A LIQUID OR MIXTURE OF A LIQUID AND A FINE SOLID PRESENT IN AN ESSENTIALLY SELF-CONTAINING VESSEL

(75) Inventors: Michael Blechschmitt, Schifferstadt (DE); Ulrich Hammon, Mannheim (DE); Friedrich-Georg Martin, Heidelberg (DE); Klaus Joachim Mueller-Engel, Stutensee (DE); Peter Zehner, Weisenheim am Berg (DE)

(73) Assignee: BASF SE, Ludwigshafen (DE)

( * ) Notice: Subject to any disclaimer, the term of this patent is extended or adjusted under 35 U.S.C. 154(b) by 337 days.

This patent is subject to a terminal disclaimer.

(21) Appl. No.: 11/857,756

(22) Filed: Sep. 19, 2007

(65) Prior Publication Data

US 2008/0073444 A1 Mar. 27, 2008

Related U.S. Application Data

(60) Provisional application No. 60/846,094, filed on Sep. 21, 2006.

(30) Foreign Application Priority Data

Sep. 21, 2006 (DE) ..... 10 2006 045 089

(51) Int. Cl.
*A62C 5/02* (2006.01)
*B05B 9/00* (2006.01)

(52) U.S. Cl. ..... 239/8; 239/9; 239/10; 239/142; 239/143; 239/144; 366/173.2; 137/563

(58) Field of Classification Search ..... 239/8, 124–127, 239/142–144
See application file for complete search history.

(56) References Cited

U.S. PATENT DOCUMENTS 391,865 A * 10/1888 Schutte ..... 239/400
3,237,865 A * 3/1966 Kovach ..... 239/142

(Continued)

FOREIGN PATENT DOCUMENTS

DE 24 10 570 9/1975

(Continued)

OTHER PUBLICATIONS

Dr. -Ing. O. Nagel et al., Chemie-Ing. Techn., "Teil I: Die Anwendung des Ejektorprinzips zur Verbesserung der Gasabsorption in Blasensäulen", 42, Jahrg., 1970, pp. 474-479.

(Continued)

*Primary Examiner* — Len Tran
*Assistant Examiner* — James Hogan
(74) *Attorney, Agent, or Firm* — Oblon, Spivak, McClelland, Maier & Neustadt, L.L.P.

(57) ABSTRACT

A process for mixing a liquid or mixture of a liquid and a fine solid present in a vessel, in which the vessel is supplied with the same liquid or the same mixture as a motive jet of a jet nozzle which is present in the vessel and has a motive jet and a momentum exchange chamber, the suction region between motive nozzle and momentum exchange chamber being provided with a sheath which has a suction orifice below the central jet leading from the motive nozzle into the momentum exchange chamber.

18 Claims, 8 Drawing Sheets

U.S. PATENT DOCUMENTS

| | | | | | |
|---|---|---|---|---|---|
| 3,938,738 | A | * | 2/1976 | Nagel et al. | 239/9 |
| 4,014,961 | A | | 3/1977 | Popov | |
| 4,164,541 | A | * | 8/1979 | Platz et al. | 422/198 |
| 4,177,246 | A | * | 12/1979 | Stoddard et al. | 423/437.1 |
| 4,255,262 | A | * | 3/1981 | O'Cheskey et al. | 210/221.2 |
| 5,159,092 | A | * | 10/1992 | Leuteritz | 554/149 |
| 5,564,825 | A | * | 10/1996 | Burt | 366/175.2 |
| 6,129,212 | A | * | 10/2000 | Muller | 209/164 |
| 6,315,012 | B1 | | 11/2001 | Fried et al. | |
| 6,517,057 | B1 | | 2/2003 | Aichinger et al. | |
| 6,518,374 | B1 | | 2/2003 | Aichinger et al. | |
| 6,910,511 | B2 | | 6/2005 | Yada et al. | |
| 7,059,759 | B2 | * | 6/2006 | Hummer | 366/137 |
| 7,334,745 | B2 | * | 2/2008 | Crawford | 239/399 |
| 7,368,601 | B2 | * | 5/2008 | Yada et al. | 562/600 |

FOREIGN PATENT DOCUMENTS

| | | |
|---|---|---|
| DE | 10 2004 034 515 | 2/2006 |
| EP | 0 419 419 | 3/1991 |
| EP | 0 856 491 | 8/1998 |
| JP | A 62 225242 | 10/1987 |
| JP | 4-43437 | 5/1992 |
| JP | 10-216490 | 8/1998 |
| JP | 2003-144882 | 5/2003 |
| WO | WO 99/21893 | 5/1999 |
| WO | WO 99/24161 | 5/1999 |
| WO | WO 99/59717 | 11/1999 |
| WO | WO 00/64947 | 11/2000 |
| WO | WO 2005/049543 | 6/2005 |

OTHER PUBLICATIONS

Office Action issued Feb. 28, 2011 in Japanese Patent Application No. 2009-528694.

* cited by examiner

PROCESS FOR MIXING A LIQUID OR MIXTURE OF A LIQUID AND A FINE SOLID PRESENT IN AN ESSENTIALLY SELF-CONTAINING VESSEL

CROSS REFERENCE TO RELATED APPLICATIONS

This application claims priority to German Application Number 10 2006 045 089.02, filed Sep. 21, 2006, and U.S. Provisional Patent Application No. 60/846,094, filed Sep. 21, 2006, the disclosures of which are incorporated herein by reference in their entireties.

BACKGROUND

The present invention relates to a process for mixing a liquid or mixture of a liquid and a fine solid present in an essentially self-contained vessel, with the proviso that the liquid or mixture fills only part of the internal volume of the vessel occupiable by a fluid phase, and the remaining occupiable internal volume of the vessel is filled by a gas phase, comprising supply of essentially the same liquid or essentially the same mixture into the vessel as a motive jet of a jet nozzle which is disposed in the liquid or in the mixture in the vessel and has a motive nozzle and a momentum exchange chamber into which the outlet of the motive nozzle points.

The storage of liquids or of mixtures of a liquid and a fine solid in essentially self-contained vessels is common knowledge (for example for the purpose of storage). Typically, such vessels are also referred to as tanks. Normally, the vessels are not entirely self-contained, but rather generally have, for example, at least one withdrawal point through which it is possible to withdraw from the contents stored in the vessel as required, for example by means of a pump. Correspondingly, the vessel typically also has at least one feed point through which the contents to be stored can be supplied to the vessel. Shutoff members (for example valves or ballcocks) normally enable the liquid or the mixture to be let in and out, and simultaneously ensure that leaks are prevented when the vessel is inactive. In a similar manner, instruments for measuring temperature, fill level and pressure in the tank (vessel) can be introduced into the vessel.

Normally, the liquid or mixture of a liquid and a fine solid which is to be stored in the tank does not completely fill the internal volume occupiable by a fluid (gaseous or liquid) phase. Instead, for a wide variety of different reasons, some of this internal volume is occupied by a gas phase. When the liquid or mixture is stored at atmospheric pressure, the essentially self-contained vessel can in principle be open to the atmosphere on the gas phase side (for example via an offgas system leading through a flare (or another offgas purification system (for example gas scrubbing))). The opening cross section is normally such that it is firstly sufficiently small and secondly such that the gases balance in the course of filling and emptying of the vessel with significant pressure drop. Typically, the mean diameters of such opening cross sections are ≦25 cm (at fill volumes of typically≧100 $m^3$, frequently up to 10 000 $m^3$). Alternatively, devices for pressure release in the event of impermissible elevated pressure or reduced pressure, which seal tight to the response pressure, which may be at or above or below atmospheric pressure, are typically likewise installed into the relevant storage vessels (for example non-return valves). Frequently, the fill level in the storage tank is determined continuously at predefined heights in the gas and in the liquid phase by metering in a small amount of a measurement gas (based on the volume of the gas phase in the vessel, generally ≦1% by volume/h). When the contents are known, the fill level is calculated directly from the difference of the metering pressure required for this purpose in each case.

In many cases, it is necessary that the contents of such a storage tank which are variable over time as a result of withdrawal and/or addition are mixed from time to time or constantly in order to increase or to ensure its homogeneity. The causes of this may be a wide variety of reasons. When the contents of the vessel are a mixture of a liquid and a fine solid (for example a slurry), there is frequently the risk that the fine solid settles out under the action of gravity during the storage in the tank, and the tank contents thus demix in the course of time. In the case of a withdrawal from the storage tank, it would then possibly, for example, no longer be the desired mixture which is withdrawn but rather only the liquid present therein. Examples of the aforementioned case include aqueous polymer suspensions. Depending on the specific weight of the liquid phase the fine solid present therein in disperse distribution can also cream and become enriched in the liquid/gaseous phase interface. One possible example of this is polymer dispersions (also aqueous polymer dispersions).

When only a liquid is stored in the tank (vessel), this may likewise be multiphasic (for example an emulsion; examples include oil-in-water emulsions and water-in-oil emulsions) and demix in the course of prolonged storage without intermediate homogenization, which is normally undesired.

However, a chemically homogeneous liquid too may form undesired physical inhomogeneities in the course of storage. These may consist, for example, of an inhomogeneous temperature distribution (for example caused by solar irradiation on one side of the tank). The consequence of this may, for example, be undesired crystal formation or unwanted decomposition of the liquid stored. Frequently, for the purpose of maintaining a desired storage temperature, a portion of the stored liquid may also be withdrawn continuously, conducted through a preferably indirect heat exchanger and then recycled into the storage tank. In this case, the storage vessel operator typically aims for very rapid temperature balancing between liquids still present in the storage vessel and liquid recycled into it via the heat exchanger by suitable rapid mixing.

For the safe storage of free-radically polymerizable compounds (or solutions comprising them), for example acrolein, methacrolein, acrylic acid, methacrylic acid and/or esters thereof (especially the $C_1$- to $C_8$-alkyl esters), not only is careful temperature control of the liquid tank contents required. Instead, so-called inhibitors (free-radical scavengers) have to be added to the aforementioned, generally at least monoethylenically unsaturated, organic compounds (monomers), in order to avert and to prevent the occurrence of an accidentally initiated, undesired free-radical polymerization. In many cases, such inhibitors display their full effect only in the presence of molecular oxygen (which may in turn itself be an inhibitor). For this reason, such monomers are normally stored under a gas atmosphere comprising molecular oxygen (cf., for example, WO 2005/049543 and U.S. Pat. No. 6,910,511), and it should be ensured that the liquid monomer (or its solution) does not become depleted of the molecular oxygen dissolved therein. The latter can occur, for example, when the monomer temporarily crystallizes out locally and then goes back into solution. The resulting local depletion of molecular oxygen can equally be counteracted by appropriate mixing.

Should undesired free-radical polymerization of the tank contents be triggered in spite of the above-described precautionary measures, it can be counteracted by adding a medium for immediately ending the free-radical polymerization to the tank contents within a very short time and distributing it over the tank contents very rapidly (cf., for example, WO 00/64947, WO 99/21893, WO 99/24161, WO 99/59717). In this case too, very uniform and rapid mixing of the tank contents is required after the medium has been added.

As shown, for example, in FIG. 1, the liquid contents 20 of a tank 10 can be mixed by bubbling or jetting through a shower head 30 a suitable gas into the tank close to the bottom. The gas bubbles 40 ascending within the liquid tank contents 20 accomplish the desired mixing by entraining liquid. The entire (in principle, the mixing action even increases from the bottom upward) liquid vessel contents is thus covered and mixed efficiently by such a large-volume flow irrespective of the height of the liquid level. However, a disadvantage of such a procedure is the constant demand for a suitable mixing gas during the mixing (on the industrial scale, comparatively large gas volume streams are required to mix the tank contents). Moreover, this gas has to be conducted back out of the tank constantly. In the case of bubbling through the liquid tank contents to be mixed, it additionally normally becomes saturated with the liquid present in the tank and, owing to this loading (for example in the case of a stored organic liquid), it frequently cannot be released into the environment in a simple manner. Instead, in most cases, comparatively complicated (expensive) offgas treatment (for example combustion (in these cases, the gas which necessarily escapes as the tank is filled is combusted in a flare) or washing) is required. In principle, the mixed gas conducted out of the tank can also be recycled back into it for bubbling through the liquid contents thereof. However, it disadvantageously necessarily requires a separate cycle gas compressor which recompresses the offgas to the pressure at the vessel bottom. Such compressors are not only expensive but also cause a high level of maintenance and a not inconsiderable energy demand.

Alternatively, the tank contents can be mixed by means of a stirrer. However, this requires a separate drive source and a drive shaft conducted through the vessel wall. However, the sealing of rotating elements conducted through a vessel wall is generally found to be particularly difficult. Moreover, in the case of large fill volumes of a tank (industrial scale fill volumes for storage tanks are typically from 100 $m^3$ to 10 000 $m^3$, frequently from 200 to 1 000 $m^3$ or from 300 to 800 $m^3$, characteristically 500 $m^3$), the manufacture of a stirrer is already comparatively expensive.

Against this background, as shown, for example, in FIG. 2, it has found to be appropriate to mix the liquid tank contents 20 by withdrawing therefrom, with the pump available for tank withdrawal, a portion of the liquid or mixture of a liquid and a fine solid 20 stored in the tank (vessel) 10, and recycling at least some of the portion withdrawn through a motive nozzle 50 which is disposed close to the bottom of the tank and is directed upward (in the simplest case a flow channel with cross section narrowing in flow direction, in which the pressure energy of a liquid flowing through is converted with low losses to additional kinetic energy, and the liquid stream is thus accelerated) as a (motive liquid) liquid jet (motive jet) into the tank.

In the course of this, the liquid jet directed upward, according to the laws of the free jet, along its path through the liquid present in the tank, is sucked in by the liquid, and the liquid media become mixed.

Alternatively or additionally, for the purpose of mixing, the filling (refilling but also first filling) of the vessel with the liquid or mixture can be effected in such a way that the liquid or mixture is supplied via an aforementioned motive jet.

However, a disadvantage of this method of mixing is that the mixing action of the free jet only captures a comparatively restricted space around it, so that the mixing action achieved is normally not entirely satisfactory (FIG. 2).

A further disadvantage is that the liquid jet (especially in the case of falling fill level in the tank), owing to its comparatively high mea momentum density (and speed), leaves the liquid phase present in the tank comparatively easily (breaks through the phase interface between liquid and gaseous phase), and this leaving may be accompanied by intense droplet formation (spray formation) within the gas phase. This is disadvantageous especially when the tank contents comprise an organic liquid (for example acrolein, methacrolein, acrylic acid, methacrylic acid, the esters of these acids or other organic monomers) whose gas phase may be explosive in the presence of molecular oxygen (cf., for example, DE-A 10 2004 034 515). Firstly, the finely distributed droplets in the gas phase increase their content of organic material, as a result of which a gas phase which may not have been explosive beforehand becomes an explosive gas phase, and the droplets formed regularly experience, in their flight through the gas phase, as a consequence of friction, electrical charging of their surface. Spark discharge which accrues as a consequence is capable of triggering ignition. When the droplets are those of an aqueous polymer dispersion, these may also, for example, film irreversibly in an undesired manner on their path through the gas phase and disrupt the polymer dispersion in later uses.

When the tank contents are the slurry of a fine solid in a liquid, the solid thrown onto the inner wall of the vessel by the jet which breaks through the phase interface may be capable of adhering to it, which removes it from the slurries stored in the vessel.

However, spray formation which is established as described above is also disadvantageous in the case of another liquid in that, inter alia, the small spray droplets have an elevated vapor pressure. This causes undesired evaporative cooling, which impairs the temperature constancy of the tank contents.

In order to intensify the mixing (cf. Chemie-Ing. Techn. 42, 1970, p. 474 to 479), as shown for example in FIG. 3, a mixing chamber 2 (open at the inlet and outlet) is arranged beyond the motive nozzle 1. As a result, the liquid present in the tank space is not, as in the case of a free jet, sucked in along the jet path, but rather the amount conveyed according to the law of momentum has to enter the inlet cross section of the mixing chamber 2 (also referred to hereinafter in simplified terms as a momentum exchange chamber or as a momentum exchange tube; cross section need not, though, necessarily be circular; however, the tubular embodiment is appropriate from an application point of view) through an inlet or suction orifice 3. This arrangement of motive nozzle and mixing chamber (which is, for example, connected downstream of the motive nozzle as a short tube with larger cross section) will be referred to hereinafter as a jet nozzle. In it, the motive jet with comparatively high speed enters a momentum exchange chamber which is comparatively small in comparison to the tank volume (frequently, the volume of the momentum exchange chamber is only from approx. 0.0001 to 1% of the internal volume of the tank) and sucks in a circulating amount of the liquid present in the tank as it does so. A manufacturer of such suitable jet nozzles is, for example, GEA Wiegand GmbH in D-76275 Ettlingen.

As shown, for example, in FIG. 4, the mixture which flows out of the momentum exchange tube 2 has an already significantly weakened momentum of its elements (a reduced mea momentum density) in comparison to the motive jet generated by the pump 60, which lowers the above-described probability of exit with droplet formation (spray formation) (it will enter only at a comparatively lower level of the phase interface and with weakened mean exit momentum density. As shown, for example, in FIG. 5, together with the suction acting from below, the outflow directed upward out of the momentum exchange tube 2 forms large-volume circular flow fields with continuous field lines, which, in the case of a jet nozzle directed obliquely upward and preferably mounted in the tank so as to be slightly raised (cf., for example, Acrylate Esters, A Summary Of Safety And Handling, 3rd Edition, 2002, compiled by Atofina, BASF, Celanese, Dow and Rohm & Haas), causes improved (especially more complete) mixing compared to the motive nozzle 1, which, however, still has room for improvement. Furthermore, as shown, for example, in FIG. 6, when the fill level (the phase interface) falls below the suction level, the motive jet here too passes unhindered through the momentum exchange tube and sprays to form fine droplets with the risks already described (FIG. 6). In general, the motive jet liquid, before it enters the jet nozzle, therefore has to flow through valves which, when the fill level in the tank goes below a predefined level, close and prevent flow through them.

In view of this prior art, it was an object of the invention to provide an improved process for mixing liquid tank contents, which can be applied to all above-described problem cases and not least also enables more rapid mixing.

SUMMARY

Accordingly a process is provided for mixing a liquid or mixture of a liquid and a fine solid present in an essentially self-contained vessel, with the proviso that the liquid or mixture fills only part of the internal volume of the vessel occupiable by a fluid phase, and the remaining occupiable internal volume of the vessel is filled by a gas phase, comprising supply of essentially the same liquid or essentially the same mixture into the vessel as a motive jet of a jet nozzle which is disposed in the liquid or in the mixture in the vessel and has a motive nozzle and a momentum exchange chamber into which the outlet of the motive nozzle points, wherein the suction region between motive nozzle and momentum exchange chamber is provided with a sheath having at least one suction orifice, with the proviso that the at least one outlet orifice is below (below here means proceeding from the central jet in the direction of the vessel or tank bottom) the central jet which leads from the motive nozzle into the momentum exchange chamber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
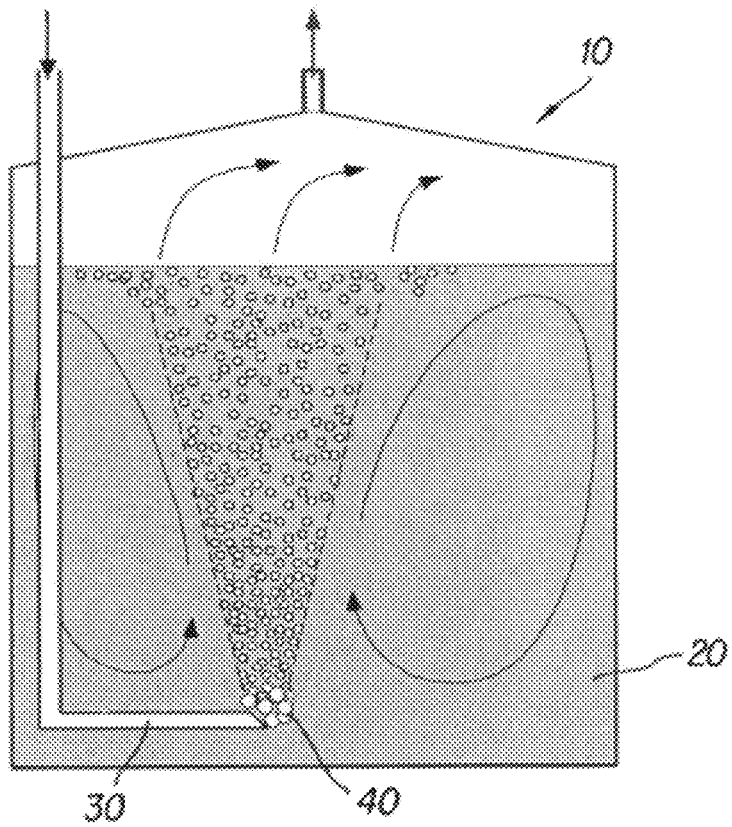
FIG. 1 PRIOR ART
FIG. 1 is a schematic depiction of a known vessel for storing a liquid or a mixture of a liquid and a fine solid.

Referring now to the drawings, wherein like reference numerals designate identical or corresponding parts throughout the several views.

Appropriately in accordance with the invention, the process according to the invention can be performed in a simple manner in such a way that it comprises the withdrawal of a portion of the liquid or of the mixture from the vessel and the recycling of at least some of the portion withdrawn as a constituent of the motive jet of the jet nozzle to be used in accordance with the invention.

Appropriately in accordance with the invention, the process according to the invention can be performed in a simple manner in such a way that it comprises the withdrawal of a portion of the liquid or of the mixture from the vessel and the recycling of at least some of the portion withdrawn as a constituent of the motive jet of the jet nozzle to be used in accordance with the invention. In principle, the motive jet of the jet nozzle to be used in accordance with the invention in the process according to the invention may also exclusively be at least some (or the entirety) of the liquid or mixture present in the vessel which has been withdrawn from the vessel beforehand.

If required, any part of the portion withdrawn which is not recycled as a motive jet can be sent to other uses.

It will be appreciated that the process according to the invention can also be performed without the liquid or mixture fed as a motive jet into the vessel comprising liquid or mixture withdrawn from the vessel. This is possible, for example, by virtue of the liquid or mixture to be conducted into the vessel for refilling being supplied to the vessel as a motive jet of the suction apparatus. It will be appreciated that the motive jet of the suction apparatus in the process according to the invention may also consist of a mixture of liquid or mixture to be conducted into the vessel for the purpose of refilling, and liquid or mixture withdrawn beforehand from the vessel.

It is favorable in accordance with the invention that the pump which delivers the motive jet may be identical to the pump to be used to withdraw the liquid/mixture stored in the vessel.

In the case of stored liquids (or other chemicals stored in liquid form) comprising (meth)acrylic monomers, useful such delivery pumps are, for example, the delivery pumps with double slide ring seal recommended in WO 2004/003389.

Useful alternative delivery pumps to these are, for example, those of U.S. Pat. No. 5,727,792, U.S. Pat. No. 4,168,936, EP-A 1 092 874 and U.S. Pat. No. 4,865,333.

Advantageously in accordance with the invention, as shown, for example, in FIG. 7, the at least one suction orifice 3 is configured as at least one immersed tube 5 which opens out from the sheath 4 toward the vessel bottom, and as a result is disposed close to the vessel bottom (this causes particularly rapid mixing owing to the suction from below).

Generally, the immersed tube is configured in such a way that flow through it causes a minimum pressure drop. In principle, the at least one suction orifice can also be designed as holes and/or slots distributed in the wall of the immersed tube over its length. The immersed tube may also, at its end disposed close to the bottom, be curved upward like a meat hook, so that the suction orifice does not point toward the vessel bottom but rather toward the vessel roof (cover). The curve may also be designed like a golf club and open out with the suction orifice parallel to the vessel bottom. In addition, the immersed tube including suction orifice may project into a pot which is open at the top and rests on the vessel bottom. It is also favorable that the suction orifice of the immersed tube and the outlet from the momentum exchange chamber (tube) can be positioned in spatial terms independently of one another (for example at a maximum distance from one another) (are no longer necessarily correlated with one another in their spatial position).

As a result of the inventive jet nozzle variant, there is still suction even in the case of a comparatively low level of the liquid vessel contents therein.

Figure 4:
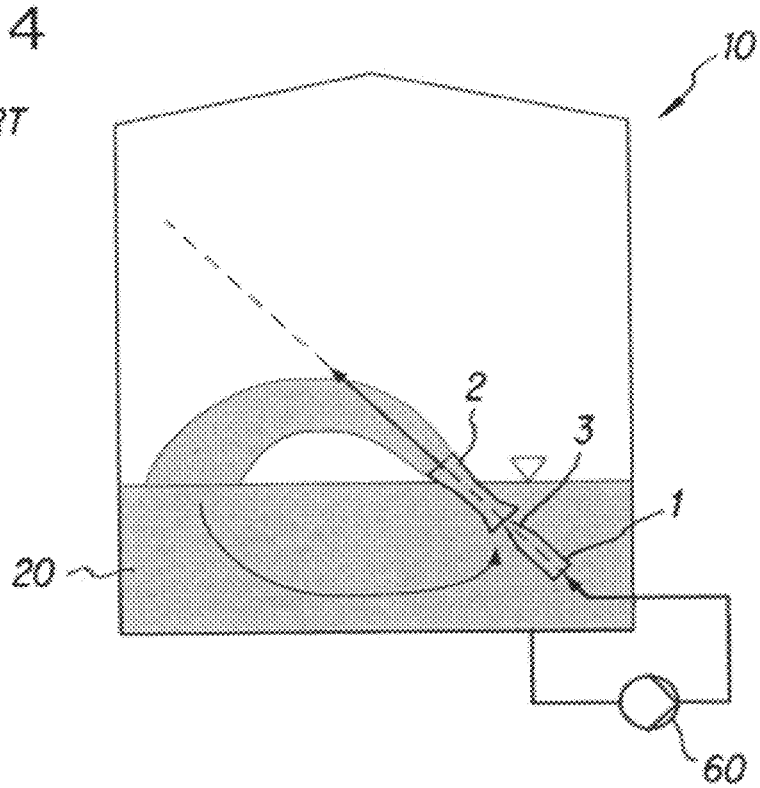
FIG. 4 PRIOR ART
FIG. 4 is a schematic depiction of a known vessel for storing a liquid or a mixture of a liquid and a fine solid.
Figure 5:
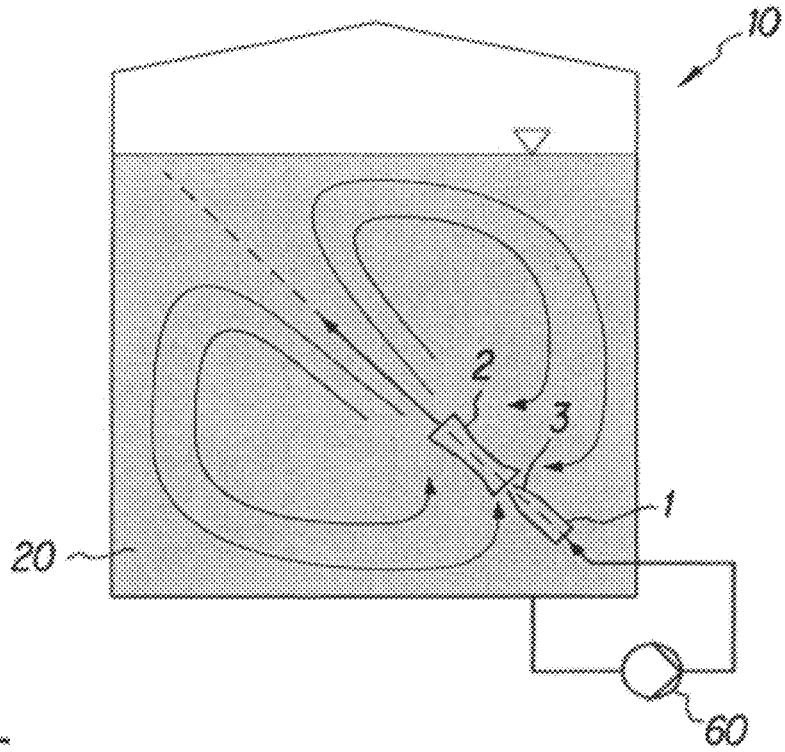
FIG. 5 PRIOR ART
FIG. 5 is a schematic depiction of a known vessel for storing a liquid or a mixture of a liquid and a fine solid.
Figure 6:
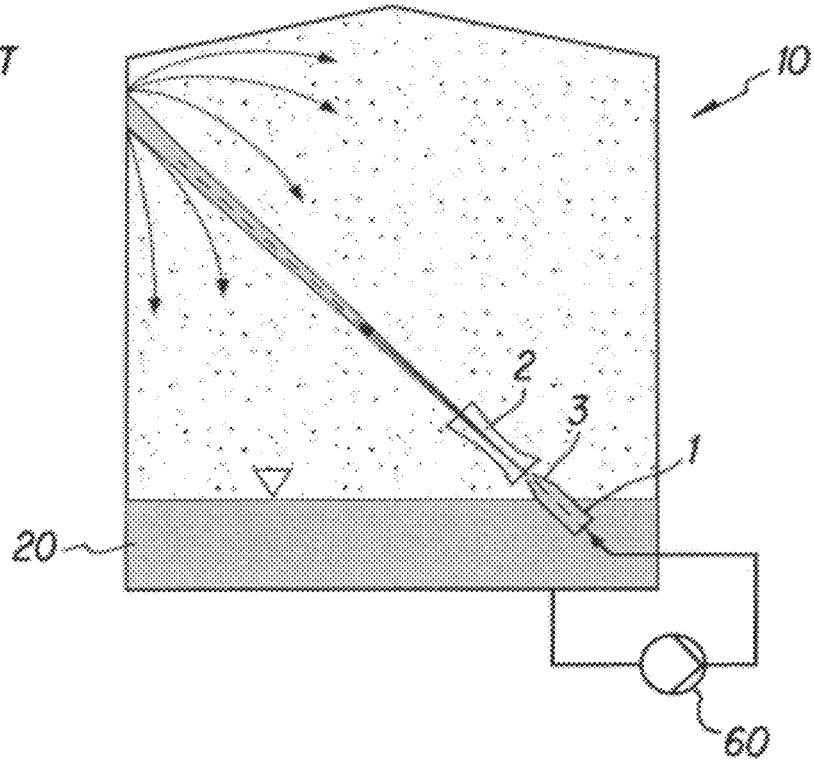
FIG. 6 PRIOR ART
FIG. 6 is a schematic depiction of a known vessel for storing a liquid or a mixture of a liquid and a fine solid.
Figure 8:
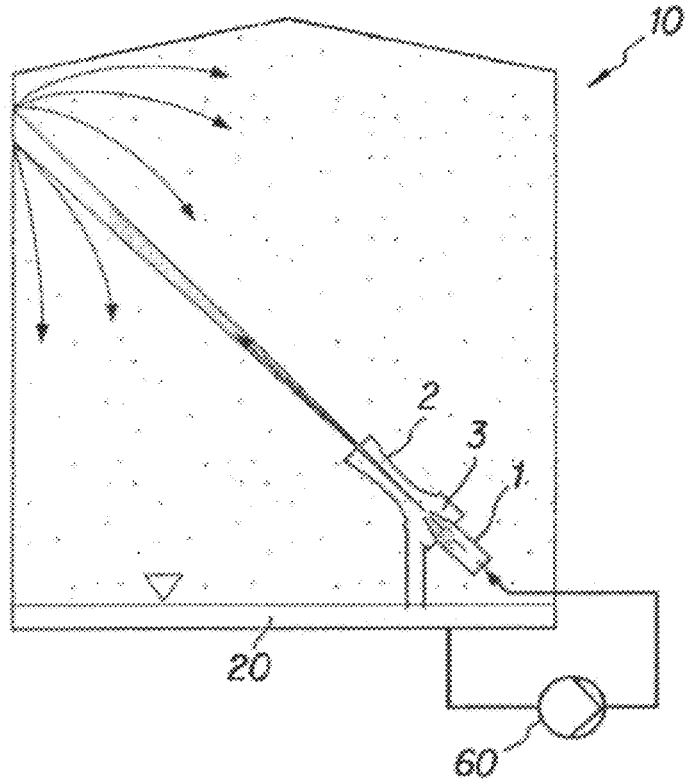
FIG. 8 is a schematic depiction of an exemplary vessel for storing a liquid or a mixture of a liquid and a fine solid according to the present invention.

Moreover, this considerably reduces the speed of the motive jet leaving the motive nozzle. Comparable flow conditions to those in FIG. 4 occur without significant spray formation. The inventive immersed tube variant in particular still permits, even in the case of extremely low fill level in the storage vessel, essentially virtually unimpaired performance of the process according to the invention. At worst, this becomes problematic when the delivery pump is briefly switched off. In this case, as shown, for example, in FIG. 8, the immersed tube 5 is no longer filled toward the motive nozzle 1 with the stored liquid or the stored mixture of liquid and fine solid 20, but rather with gas.

Motive nozzles whose nozzle openings generate liquid jets with increased turbulence are particularly advantageous for this case because jet nozzles which leave with increased turbulence cause an increased suction force in order to raise the liquid or mixture level in the immersed tube to the required degree immediately after restart, and to be able to continue the inventive procedure (motive jets which leave with increased turbulence entrain the gas particularly effectively out of the suction chamber, since the contact surface area between gas and liquid phase is increased).

Figure 3:
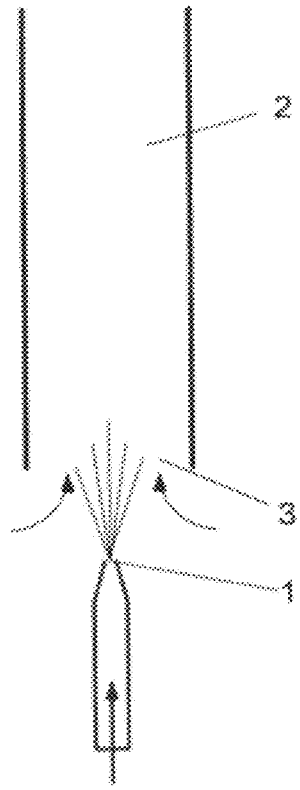
FIG. 3 PRIOR ART
FIG. 3 is a schematic depiction of a known vessel for storing a liquid or a mixture of a liquid and a fine solid.

In the case of no raising, the motive jet otherwise hits the vessel wall uninhibited on restart, with the disadvantageous effects already described. An additional improvement, advantageous in accordance with the invention in the aforementioned sense, in the widening of the motive jet beyond its outlet from the motive nozzle is achieved when a slight swirling motion is imparted to it before it passes through the motive nozzle. As shown, for example, in FIG. 9, this is possible by installing a suitable swirl body 6 just upstream of the motive nozzle 1. Useful such swirl bodies are, advantageously in accordance with the invention, for example blade rings, as shown in FIG. 3 in vt>>verfahrenstechnik<<15 (1981) No. 10 on page 739. When swirl bodies which impart too great a swirl to the liquid jet are used (i.e. too highly swirled turbulent motive jets), however, a deterioration in the suction performance can also occur. In principle, the swirling can also be generated by a tangential motive liquid supply into the motive nozzle.

Figure 2:
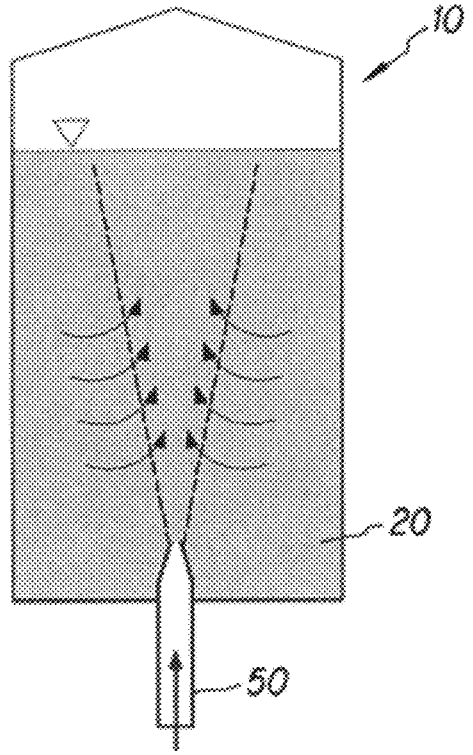
FIG. 2 PRIOR ART
FIG. 2 is a schematic depiction of a known vessel for storing a liquid or a mixture of a liquid and a fine solid.

Alternatively and/or additionally to the swirling of the motive jet, it can be divided (into a plurality of individual jets), for example, by virtue of the exit cross section of the motive jet having a multitude of exit orifices (the cross section of the motive nozzle is provided with a motive jet divider). In the simplest manner, this is realizable by incorporating a screen (plate) which has multitude of passage orifices (in the simplest case annular) into the exit cross section of the motive jet, as shown, for example, in FIG. 2 from "Mixing shocks and their influence on the design of liquid-gas ejectors", J. H. Witte, thesis, Technical University, Delft (December 1962) on page 14. Instead of holes (in which case reference is made to screen or multihole nozzles), slot nozzles (for example concentric annular gaps) are also useful.

Figure 12:
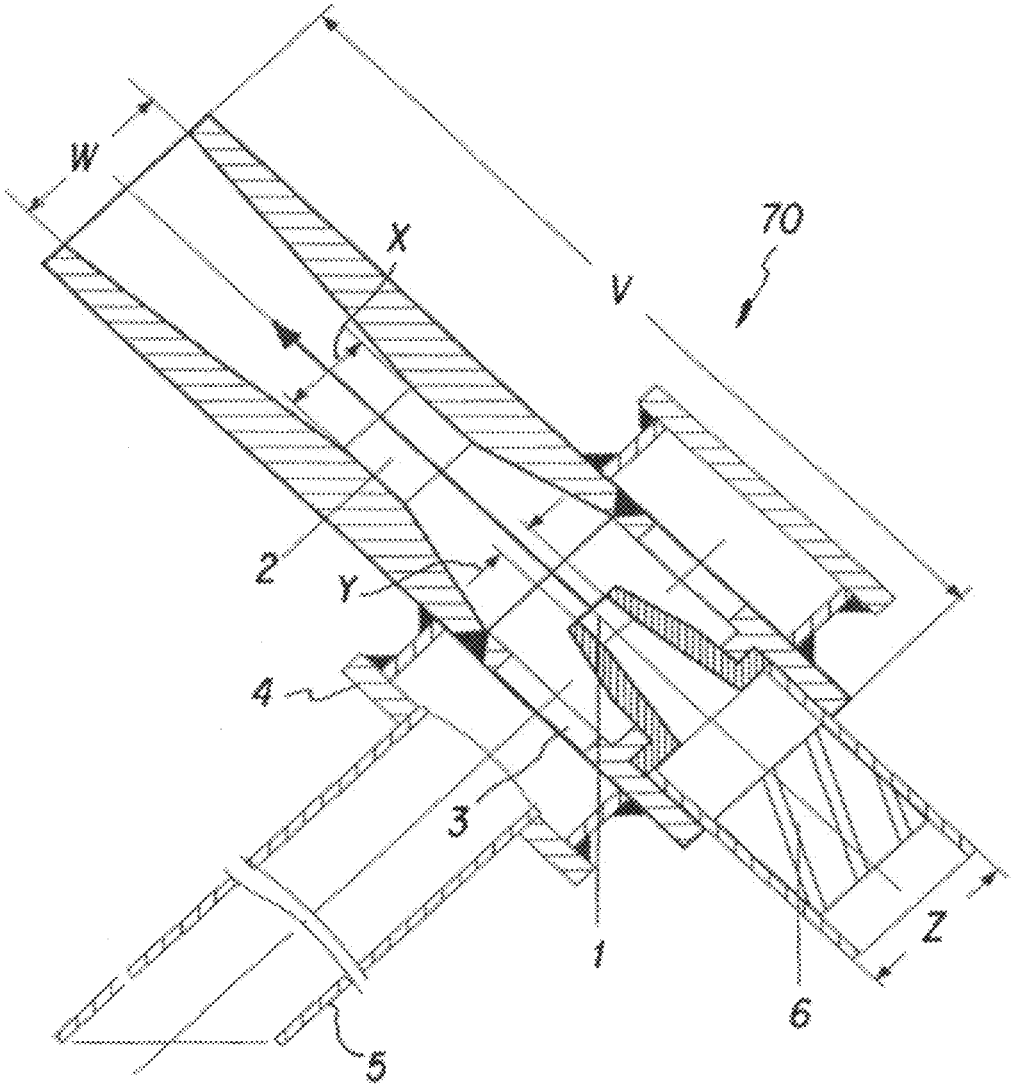
FIG. 12 is a cross-sectional view of an exemplary nozzle according to the present invention.

The jet leaving (flowing out) (and leading into the momentum exchange chamber) through the center of the narrowest cross-sectional area of the motive nozzle in the absence of the stored liquid medium will be referred to in this document as the central jet (see (5) in FIG. 12) leading from the motive nozzle into the momentum exchange chamber.

The design of a jet nozzle to be used in accordance with the invention for a specific mixing problem can be effected with reference to the connections indicated in the prior art for the conventional jet nozzle and the remarks made there (cf. also, for example, DE-A 2404289, DE-A 1557018, Chemie-Ing.-Tech. 61 (1989) No. 11, pages 908-909, Chemie-Ing.-Techn. 47, 1975, No. 5, page 209 and Chemie-Ing.-Techn. MS 201/75). Useful manufacturing materials, adjusted to the properties of the stored liquid/mixture, include both stainless steels and plastics (for example fiber-reinforced plastic matrices, as recommended in EP-A 245844). When the storage contents are acrylic acid, methacrylic acid, their esters or solutions thereof, a recommended material for the jet nozzle is in particular stainless steel of DIN material numbers 1.4541 and 1.4547.

In principle, the momentum exchange chamber and the motive nozzle may be connected to one another via connecting elements (preferably via three connecting elements (enable completely satisfactory centering), of which in each case two enclose an angle of 120°). However, they may also be screwed into one another. In this case, slots mounted in the simplest case in the sheath toward the vessel bottom or at least one immersed tube leading seamlessly into the sheath permit the sucking-in of the ambient liquid.

In principle, the inventive use of an inventive jet nozzle is sufficient for the process according to the invention. Appropriately in accordance with the invention, it is mounted in the storage vessel in a slightly raised manner (the outlet from the momentum exchange chamber is advantageously at a height of from 10 to 30%, preferably from 15 to 25%, of the maximum fill height of the storage vessel; elevated positions of the jet nozzle are preferred in slim vessels). Typically, a jet nozzle used in accordance with the invention is not disposed at the center of the storage vessel but rather close to the wall. The angle between a horizontal to the vessel bottom and the (theoretical) central jet of the liquid exiting from the motive nozzle is variable within a wide range and may, for example, assume values of from −90° to +90°, and for example 45°. Relatively large angles are preferred in slim tanks and relatively small angles in flat tanks. However, it will be appreciated that it is also possible in accordance with the invention for a plurality of inventive jet nozzles to be operated simultaneously in one and the same vessel. Appropriately from an application point of view, jet nozzles of the same size will be used. The jet nozzles may in principle be arranged in any position relative to one another in the tank. The angles between a vertical to the vessel bottom and the (theoretical) central jet of the liquid exiting from the jet nozzle may also assume a wide variety of different values. In addition, the particular outlet from the particular momentum exchange chamber of the particular jet nozzle may also be disposed at different heights in the storage tank. Appropriately from an application point of view, the aforementioned angles to the horizontal and the particular outlet height are, however, adjusted so as to be largely identical.

Favorably in accordance with the invention, for example, two jet nozzles (each mounted close to the vessel wall) are then mounted opposite one another, or three jet nozzles on the corners of an equilateral triangle, or four jet nozzles on the corners of a square.

It is also possible in accordance with the invention, in the case of one jet nozzle, to combine a plurality of motive nozzles with a common momentum exchange chamber, in which case its cross section of the entry orifice should correspond to the sum of the cross section required for the particular motive nozzle in the case of its individual use.

The amount of liquid sucked in per unit time through the at least one jet nozzle in addition to its motive jet from the environment of the jet nozzle into the sheath of the motive nozzle/momentum exchange tube transition (and hence into this transition) when the process according to the invention is performed is a multiple of the motive liquid pumped into the motive nozzle per unit time (generally from 1 or 2 to 10 times (in many cases up to 100 times), frequently from 4 to 8 times).

The mass flow which leaves the momentum exchange chamber in the process according to the invention generally has a momentum density of from $10^3$ to $10^5$ N/m$^2$, preferably from $5\cdot10^3$ to $2\cdot10^4$ N/m$^2$. In contrast, the mean momentum density of the motive jet in the process according to the invention is typically from $2.5\cdot10^4$ to $10^7$ N/m$^2$, frequently from $10^5$ to $5\cdot10^6$ N/m$^2$.

Moreover, the volume of the momentum exchange chamber (which is open at the inlet and at the outlet) is very small in comparison to the vessel volume in the process according to the invention. In general, the volume of the momentum exchange chamber is from one hundredth to one hundred thousandth or to one millionth of the maximum liquid capacity of the vessel.

In principle, the momentum exchange chamber of the jet nozzle to be used in accordance with the invention may be configured in various shapes, this shape appropriately being adjusted to the shape of the motive nozzle.

The momentum exchange chamber normally has a constant cross section in flow direction, which may be circular, or angular (for example triangular, square or rectangular), or oval, etc. In principle, the momentum exchange chamber may also have a cross section which increases in flow direction. In general, the moment exchange chamber (mixing chamber) used is cylindrical tubes and/or cone segments.

The mean diameter of the entry orifice of the momentum exchange chamber will generally be from 2 to 20 times, preferably from 4 to 10 times, the mean diameter of the motive nozzle, and the length of the momentum exchange chamber will typically be from 3 to 30 times, preferably from 3 to 10 times, its hydraulic diameter.

The mean diameter is understood to mean the diameter of a circle which has the same area as the cross section in question (which may also be polygonal or oval) of the nozzle or of the entry orifice of the momentum exchange chamber, neither of which need necessarily be circular.

When the momentum exchange chamber is configured as a cylindrical tube, its length will generally be from 3 to 30 times, preferably from 3 to 10 times its diameter, which in this case is simultaneously its hydraulic diameter.

When the momentum exchange chamber does not have a circular cross section or does not have a constant cross section over its length, its length will normally be from 3 to 30 times, preferably from 3 to 10 times its hydraulic diameter. The hydraulic diameter is understood to mean the diameter of a cylindrical tube which, in the case of the same throughputs and same length, exhibits the same pressure drop as the momentum exchange chamber in question.

The at least one suction orifice may, in the process according to the invention, be disposed in the direction of the motive jet in the sheath either upstream of or beyond the narrowest cross section in the motive nozzle.

The speed of the motive liquid when it leaves the motive nozzle will generally be from 5 to 100 m/s, preferably 10 to 70 or to 30 m/s.

On entry of the motive jet which flows out of the motive nozzle into the momentum exchange chamber, the liquid medium stored in the vessel is sucked from the environment via the at least one suction orifice in processes according to the invention. This sucked-in "second" liquid stream is accelerated on entry into the momentum exchange chamber. At the same time, the two liquid streams are mixed highly intensively with exchange of momentum after their entry into the momentum exchange chamber. As a result of momentum exchange in the momentum exchange chamber and as a result of conversion of the kinetic energy to pressure energy therein, the momentum density of the motive jet is reduced as it passes through the momentum exchange chamber.

The mean diameter of the at least one suction orifice in the sheath of the "suction region" between motive nozzle and momentum exchange chamber will normally be from 1 to 10 times, preferably from 2 to 5 times and more preferably from 2 to 3 times the mean diameter of the cross section of the inlet (the inlet cross section) into the momentum exchange chamber.

Figure 7:
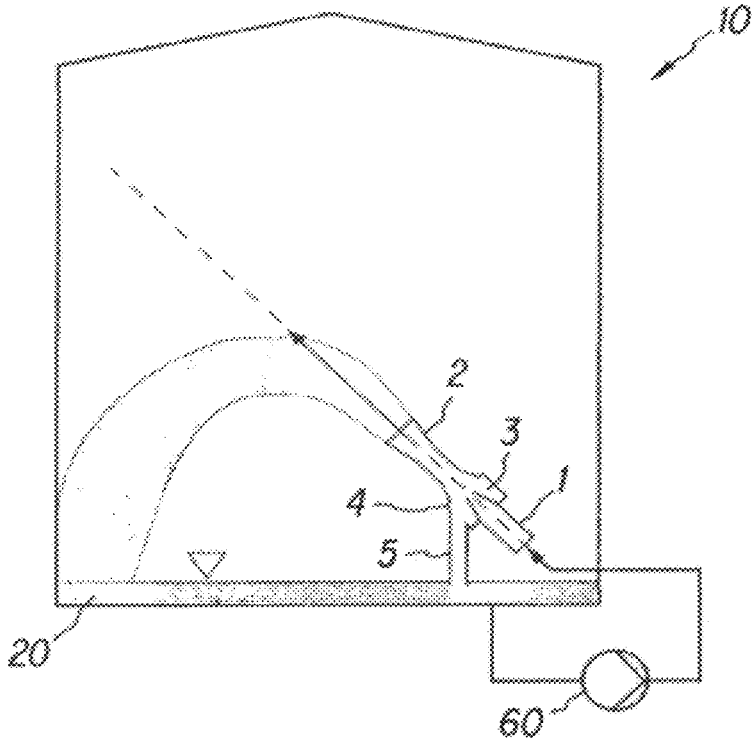
FIG. 7 is a schematic depiction of an exemplary vessel for storing a liquid or a mixture of a liquid and a fine solid according to the present invention.

When the aforementioned suction orifice is configured as at least one immersed tube opening out toward the vessel bottom, as shown in FIG. 7, the direct distance, measured from the suction orifice of the immersed tube up to the entrance of the immersed tube into the sheath, can be adjusted variably within a wide range.

It will be appreciated that the cross section of the immersed tube may in principle be as desired, i.e. circular, oval or polygonal. Normally, the cross section of the immersed tube in processes according to the invention is constant over its length. Immersed tubes with circular cross section are preferred in accordance with the invention.

The immersed tube may be welded seamlessly to the sheath, or be screwed into the sheath, or be connected to an appropriate connection present in the sheath (for example flanged onto a connecting stub).

It is advantageous in accordance with the invention for the process according to the invention that it is, in its use, largely independent of the volume fraction of the gas phase in the vessel in the total internal volume of the vessel. For example, in the process according to the invention, the volume of the gas phase in the vessel may be at least 5% by volume, or at least 10% by volume, or at least 20% by volume, or at least 25% by volume, or at least 30% by volume, or at least 35% by volume, or at least 40% by volume of the vessel volume.

It is also favorable in accordance with the invention when, when the process according to the invention is performed, at least $10^{-5}$ or at least $10^{-2}$ liter of liquid (consisting of motive jet liquid conducted through the motive nozzle and "second" liquid stream sucked in through the at least one orifice) (but generally not more than 1 or not more than 0.1 liter) per minute per liter of liquid contents of the storage vessel flows through the momentum exchange chamber.

The vessel itself advantageously has cylindrical (for example with circular or square or rectangular cross section) structure which is concluded at the top by a conical roof or by a hemispherical or dome-shaped roof.

The process according to the invention is suitable in particular for the advantageous storage of all liquids mentioned at the outset of this document or mixtures of a liquid and a fine solid. These are generally shipped blanketed with a gas which is saturated with the vapor of the liquid (i.e. the gas phase typically does not consist only of evaporated liquid).

Useful such gases include, for example, inert gases such as $N_2$, noble gases, for example Ar, and/or $CO_2$.

It will be appreciated that such gases may also be air, or other mixtures of molecular oxygen and inert gas. The absolute pressure in the tank may, for example, be from atmospheric pressure to 50 bar; the temperature in the tank may, for example, be from 0 (or less) to 100 (or more) ° C.

Neither of the two aforementioned parameters is subject to any restriction in the process according to the invention.

The process according to the invention is particularly advantageous when the stored liquid is at least one monoethylenically unsaturated organic compound (for example N-vinylformamide, vinyl acetate, esters of maleic acid, styrene and/or N-substituted acrylamides) or a solution comprising at least one such monoethylenically unsaturated organic compound, especially when it comprises an added polymerization inhibitor for the purpose of inhibiting undesired free-radical polymerizations.

Further examples of such at least monoethylenically unsaturated organic compounds include acrolein, methacrolein, acrylic acid, methacrylic acid and esters of acrylic acid and/or methacrylic acid and mono- or polyhydric alkanols. These esters include in particular those whose alcohol has from one to twenty carbon atoms, or from one to twelve carbon atoms, or from one to eight carbon atoms. Exemplary representatives of such esters include methyl acrylate, ethyl acrylate, n-butyl acrylate, isobutyl acrylate, tert-butyl acrylate, 2-ethylhexyl acrylate, hydroxyethyl acrylate, hydroxypropyl acrylate, hydroxyethyl methacrylate, hydroxypropyl methacrylate, methyl methacrylate, ethyl methacrylate, n-butyl methacrylate and tert-butyl methacrylate. Useful inhibitors of free-radical polymerizations for the aforementioned monomers and their solutions in organic or aqueous solvents are, for example, the monomethyl ether of hydroquinone (MEHQ), hydroquinones, phenols (e.g. 2,4-dimethyl-6,6-butylphenol), quinones, butylpyrocatechol, phenothiazine, diphenylamine, p-phenylenediamines, nitroxyl radicals and/or nitroso compounds, for example nitrophenols (and also all other polymerization inhibitors mentioned in WO 00/64947). Based on the monomer content, the amount of polymerization inhibitors added for the purpose of storage may be from 0.5 to 1000 ppm by weight (frequently from 1 to 600 ppm by weight or from 2 to 500 ppm by weight).

In the case of glacial acrylic acid (acrylic acid content≧99.5% by weight), generally 200±20 ppm by weight of MEHQ are added as a storage inhibitor (storage temperature recommendation: 15 to 25° C.). In the case of n-butyl acrylate (n-butyl acrylate content≧99.5% by weight) and the other (meth)acrylic esters, generally 15±5 ppm by weight of MEHQ are added as a storage stabilizer (storage temperature recommendation: 20 to 35° C.). MEHQ is also the preferred storage stabilizer for the other (meth)acrylic monomers mentioned and solutions thereof.

As already mentioned, aforementioned polymerization inhibitors (especially MEHQ) display their full inhibiting action generally only in the presence of molecular oxygen.

However, especially (meth)acrylic monomers are capable of forming explosive mixtures with molecular oxygen.

In order to rule out a corresponding explosion even in the case of spray (spray formation) in the storage tank, it has been necessary to date either to prevent such spray formation by means of a liquid level control which is widely available from a safety technology point of view, or to correspondingly restrict the oxygen content of the gas phase in the storage tank, as recommended in WO 2005/049543 in the context of U.S. Pat. No. 6,910,511.

The use of the inventive procedure, with whose aid it is possible to prevent spray formation even with a comparatively low liquid level in the vessel, permits, in comparison, the comparatively simple and reliable blanketing of the tank contents with air saturated with the liquid stored in the tank. When, however, the stored acrylic acid is acrylic acid which has been obtained by heterogeneously catalyzed partial gas phase oxidation of propylene in the presence of propane or by heterogeneously catalyzed partial gas phase oxidation of propane itself, the crude acrylic acid to be stored, after its removal from the product gas mixture, is generally obtained in a form saturated with propane. In this case, the gas mixture additionally comprises combustible propane. For safe storage, it is advisable in this case to comply with the lower limit in the limiting oxygen concentration by storage under lean air according to WO 2005/049543 in the gas phase.

In principle, with decreasing fill level in the storage vessel in the process according to the invention, the recycle rate to form the motive jet can be reduced.

The present application thus comprises in particular the following inventive embodiments:

A first embodiment includes a process for mixing a liquid or mixture of a liquid and a fine solid present in an essentially self-contained vessel, with the proviso that the liquid or mixture fills only part of the internal volume of the vessel occupiable by a fluid phase, and the remaining occupiable internal volume of the vessel is filled by a gas phase, comprising supply of essentially the same liquid or essentially the same mixture into the vessel as a motive jet of a jet nozzle which is disposed in the liquid or in the mixture in the vessel and has a motive nozzle and a momentum exchange chamber into which the outlet of the motive nozzle points, wherein the suction region between motive nozzle and momentum exchange chamber is provided with a sheath having at least one suction orifice, with the proviso that the at least one outlet orifice is below the central jet which leads from the motive nozzle into the momentum exchange chamber.

A second embodiment includes a process according to the first embodiment, wherein the at least one suction orifice is configured as at least one immersed tube which opens out from the sheath toward the vessel bottom.

A third embodiment includes a process according to either the first embodiment or the second embodiment, wherein a swirling motion is imparted to the motive jet before it passes through the motive nozzle.

A fourth embodiment includes a process according to any one of the first through third embodiments, wherein the swirling motion is imparted with a swirl body installed upstream of the motive nozzle.

A fifth embodiment includes a process according to any one of the first through third embodiments, wherein the swirling motion is imparted by supplying the motive liquid to the motive nozzle tangentially.

A sixth embodiment includes a process according to any one of the first through fifth embodiments, wherein the motive jet is divided as it passes through the motive nozzle.

A seventh embodiment includes a process according to embodiment tithe sixth embodiment, wherein the motive nozzle is a screen nozzle or a slot nozzle.

An eighth embodiment includes a process according to any one of the first through seventh embodiments, wherein the liquid comprises at least one of the organic compounds from the group comprising acrolein, methacrolein, acrylic acid, methacrylic acid, esters of acrylic acid and esters of methacrylic acid.

A ninth embodiment includes a process according to any one of the first through seventh embodiments, wherein the liquid comprises N-vinylformamide.

A tenth embodiment includes a process according to any one of the eighth and ninth embodiments, wherein the liquid comprises at least one dissolved polymerization inhibitor.

An eleventh-embodiment includes a process according to any one of the first through tenth embodiments, wherein the gas phase comprises molecular oxygen.

A twelfth embodiment includes a process according to any one of the first through eleventh embodiments, wherein the liquid or mixture fed into the vessel as a motive jet comprises a portion or the entirety of a portion of the liquid or mixture present in the vessel which has been withdrawn beforehand from the vessel.

A thirteenth embodiment includes a process according to any of one of the first through eleventh embodiments, wherein the liquid or mixture fed into the vessel as a motive jet does not comprise a portion of the liquid or mixture present in the vessel which has been withdrawn beforehand from the vessel.

A fourteenth embodiment includes a process according to any of one of the first through thirteenth embodiments, wherein the liquid or mixture guided into the vessel as a motive jet has been conducted through a heat exchanger beforehand.

A fifteenth embodiment includes a process according to any one of the first through fourteenth embodiments, wherein at least $10^{-5}$ liter per minute per liter of liquid present in the vessel of essentially the same liquid, consisting of motive jet liquid conducted through the motive nozzle and liquid stream sucked in through the at least one suction orifice, flows through the momentum exchange chamber.

A sixteenth embodiment includes a process according to any one of the first through fourteenth embodiments, wherein at least $10^{-5}$ liter per minute per liter of mixture of a liquid and a fine solid present in the vessel of essentially the same mixture, consisting of motive jet mixture conducted through the motive nozzle and mixture stream sucked in through the at least one suction orifice, flows through the momentum exchange chamber.

A seventeenth embodiment includes a jet nozzle which has a motive nozzle and a momentum exchange chamber into which the outlet of the motive nozzle points, wherein the suction region between motive nozzle and momentum exchange chamber is provided with a sheath which has at least one suction orifice which opens out to an immersed tube or at least one connection for such an immersed tube.

An eighteenth embodiment includes the use of a jet nozzle according to the seventeenth for mixing a liquid or mixture of a liquid and a fine solid present in an essentially self-contained vessel, with the proviso that the liquid or mixture fills only part of the internal volume of the vessel occupiable by a fluid phase, and the remaining occupiable internal volume of the vessel is filled by a gas phase.

The process according to the invention is also suitable for very rapidly mixing another liquid or another mixture into a liquid or mixture of a liquid and a fine solid present in an essentially self-contained vessel, with the proviso that the liquid or mixture fills only part of the internal volume of the vessel occupiable by a fluid phase and the remaining occupiable internal volume of the vessel is filled by a gas phase (and also irrespective of the given fill level in the vessel).

In this case, the procedure in the simplest manner is that the mixture or liquid to be supplied as the motive jet in accordance with the invention is exclusively the other liquid or other mixture to be mixed in. In order to further promote the formation of a homogeneous mixture in the vessel on completion of supply of the other liquid or the other mixture, appropriately in accordance with the application, a portion of the total amount of liquid or mixture which is then present in the vessel will then be withdrawn therefrom, for example with the pump available for vessel withdrawal, and at least some of the portion withdrawn (if appropriate after it has been conducted through a heat exchanger) will be recycled as the motive jet an inventive jet nozzle which is present in the liquid or in the mixture in the vessel and is to be used in accordance with the invention into the vessel.

Alternatively, the procedure may also be to initially use a mixture of the other liquid or the other mixture and a portion of the liquid or mixture present therein which has been withdrawn beforehand as the motive jet of the inventive jet nozzle to be used in accordance with the invention. In order to further promote the formation of a homogeneous mixture in the vessel on completion of supply of the total amount of the other liquid or the other mixture to be supplied, appropriately in accordance with the application, a portion of the total amount of liquid or mixture which is then present in the vessel will then be withdrawn therefrom, for example with the pump available for vessel withdrawal, and at least some of the portion withdrawn (if appropriate after it has been conducted through a heat exchanger) will be recycled as the motive jet of an inventive jet nozzle which is present in the liquid or in the mixture in the vessel and is to be used in accordance with the invention into the vessel.

If appropriate, on completion of supply of the total amount of the other liquid or of the other mixture supplied, the formation of a homogeneous mixture in the vessel can also be promoted further by supplying essentially the same liquid or mixture as a motive jet without having withdrawn it from the vessel beforehand.

When the liquid present in the vessel, or the liquid of the mixture present in the vessel, is one which already comprises at least one compound having at least one ethylenically unsaturated moiety (for example acrolein, methacrolein, acrylic acid, methacrylic acid, esters of acrylic acid and/or esters of methacrylic acid) (generally in a form stabilized by adding polymerization inhibitors), there may be undesired free-radical polymerization for a wide variety of different reasons. In order to stop such an undesired free-radical polymerization very rapidly before it becomes more marked, the essentially immediate mixing of highly concentrated solutions of free-radical polymerization inhibitors is recommended in the prior art (cf. WO 00/64947, WO 99/21893, WO 99/24161, WO 99/59717).

Such solutions may, for example, be a liquid to be mixed in accordance with the invention as described above. In particular, such "short stop solutions" may be inhibitor solutions which comprise at least 10% by weight of phenothiazine, from 5 to 10% by weight of p-methoxyphenol and at least 50% by weight of N-methylpyrrolidone. Alternatively, all other "short stop solutions" recommended in the aforementioned WO documents are useful.

The present patent application therefore additionally comprises the following inventive embodiments:

A nineteenth embodiment includes a process for mixing another liquid or another mixture into a liquid or mixture of a liquid and a fine solid present in an essentially self-contained vessel, with the proviso that the liquid or mixture fills only part of the internal volume of the vessel occupiable by a fluid phase and the remaining occupiable internal volume of the vessel is filled by a gas phase, comprising supply of the other liquid or the other mixture into the vessel as a motive jet of a jet nozzle which is disposed in the liquid or in the mixture in the vessel and has a motive nozzle and a momentum exchange chamber into which the outlet of the motive nozzle points, wherein the suction region between motive nozzle and momentum exchange chamber is provided with a sheath having at least one suction orifice, with the proviso that the at least one outlet orifice is below the central jet which leads from the motive nozzle into the momentum exchange chamber.

A twentieth embodiment includes a process according the nineteenth embodiment, wherein the liquid present in the vessel comprises a compound having at least one ethylenically unsaturated moiety, and the other liquid supplied as a motive jet is an inhibitor solution which comprises at least 10% by weight of phenothiazine, from 5 to 10% by weight of p-methoxyphenol and at least 50% by weight of N-methylpyrrolidone.

Working Example and Comparative Example

Figure 10:
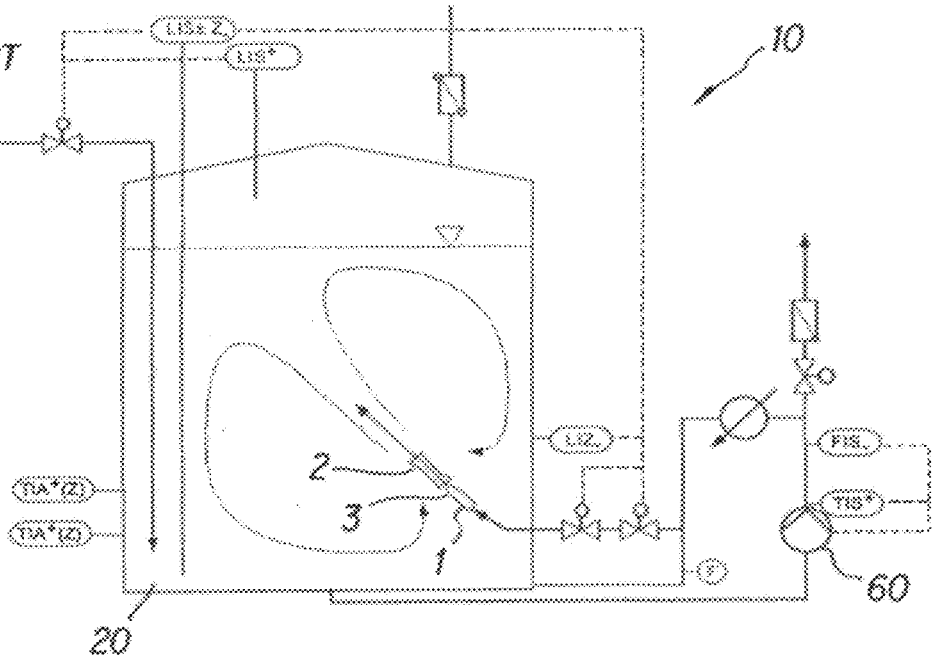
FIG. 10 PRIOR ART
FIG. 10 is a schematic depiction of a known vessel for storing a liquid or a mixture of a liquid and a fine solid.

As shown in FIG. 10, in an outdoor tank 10 (wall thickness: 5 mm, manufacturing material: DIN 1.4541 stainless steel, cylindrical footprint with a diameter of 8.5 m and a height of 10 m up to the start of the conical roof), glacial acrylic acid (GAA) stabilized with 200 ppm by weight of MEHQ was stored at a desired internal temperature of 20° C. under atmospheric pressure at maximum fill height. The maximum fill height in the storage tank was 9 m. The gas volume remaining at maximum fill height was 69 $m^3$.

The withdrawal from the tank 10 was effected by means of a CPK 50-200 centrifugal pump 60 from KSB Aktiengesellschaft in D-67227 Frankenthal.

The barrier fluid present in the pump with double slip ring seal was a mixture of ethylene glycol and water. The glacial acrylic acid in the storage tank was covered by means of air. By means of an offgas system which was open to the atmosphere via a flare (orifice cross section in the conical roof=20 $cm^2$), it was possible to release gas from the gas phase of the tank to a flare in the course of filling for pressure release. In a corresponding manner, air was replenished via a pressure-retaining device for pressure equalization in the course of withdrawal of glacial acrylic acid from the tank.

Figure 11:
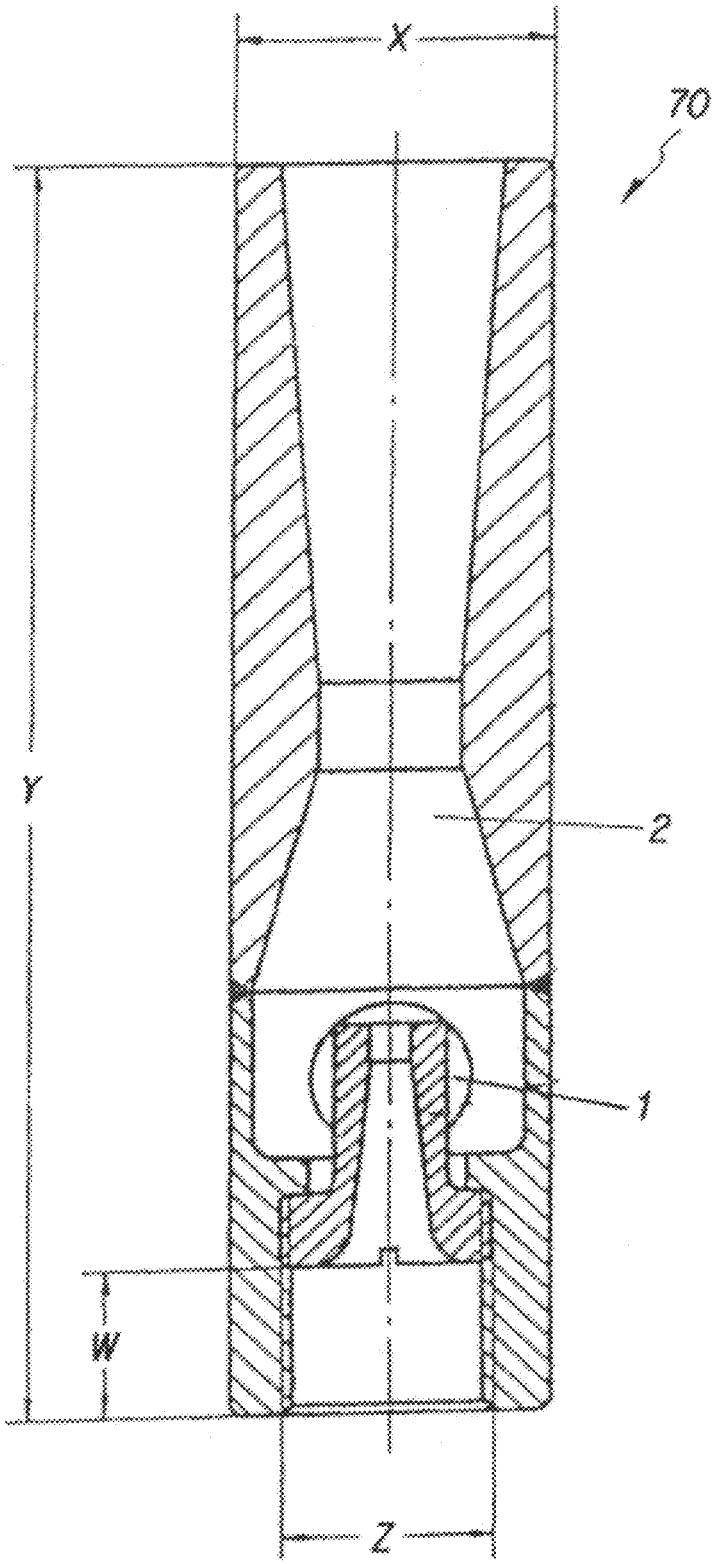
FIG. 11 PRIOR ART
FIG. 11 is a cross-sectional view of an known nozzle.

To mix the liquid tank contents 20, as shown in FIG. 10, a conventional jet nozzle from GEA Wiegand GmbH in D-76275 Ettlingen of the 17.1 type, was mounted in a slightly elevated manner with respect to the tank bottom. FIG. 11 shows the detailed configuration essentially to scale of the jet nozzle 70. The jet nozzle 70 includes a motive nozzle 1 and a momentum exchange chamber 2. The jet nozzle 70 was made of stainless steel (e.g., DIN 1.4541 stainless steel) having wall thicknesses of from 4 to 20 mm. The dimensions w, x, y and z of the jet nozzle 70 were 41, 112, 495 and 75 mm, respectively.

The centrifugal pump was used to withdraw 40 $m^3$/h of glacial acrylic acid continuously from the tank over a period of 1 week, and to recycle it as the motive jet into the ejector jet nozzle via the heat exchanger in FIG. 11. Subsequently, the recycle rate was retained, but the withdrawal rate was increased by 20 $m^3$ per hour. As the fill level reached the suction region of the jet nozzle, the valves V present in the path of the motive liquid to the jet nozzle closed in order to prevent spraying of the motive jet within the tank.

Further removal of glacial acrylic acid from the storage tank was not possible without filling it beforehand while continuing the mixing.

Figure 9:
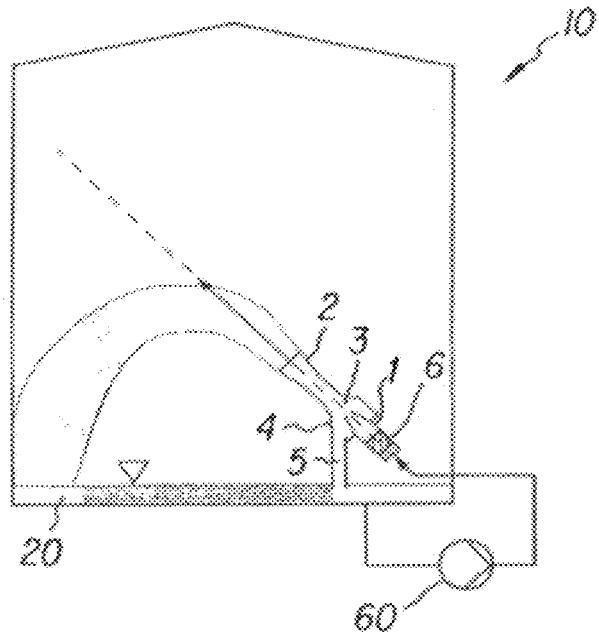
FIG. 9 is a schematic depiction of an exemplary vessel for storing a liquid or a mixture of a liquid and a fine solid according to the present invention.

The conventional jet nozzle was now replaced by an inventive jet nozzle 70, as shown in FIG. 12, manufactured from the same material, in which the swirl bodies 60 had been installed upstream of the motive nozzle 1. The dimensions v, w, x, y and z of the jet nozzle 70 were 495 mm, 90 mm, 72 mm, 20 mm and 3 inches, respectively. This was mounted in the storage tank 10 shown in FIG. 13. With opened valves V, the withdrawal of glacial acrylic acid could be continued without filling the storage tank beforehand. There was no spray formation. Even on attainment of a fill level in the tank as shown quantitatively in FIG. 8, it was possible, after temporarily shutting down the pump, to resume and continue the withdrawal operation as shown in FIG. 9 without spray formation.

Figure 14:
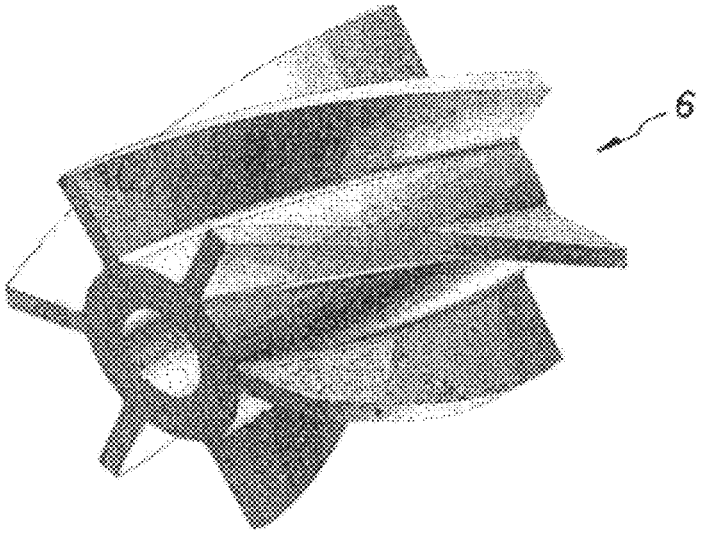
FIG. 14 is a perspective view of an exemplary swirl body according to the present invention.

FIG. 14 additionally shows the three-dimensional diagram of the swirl body 6 used.

Figure 13:
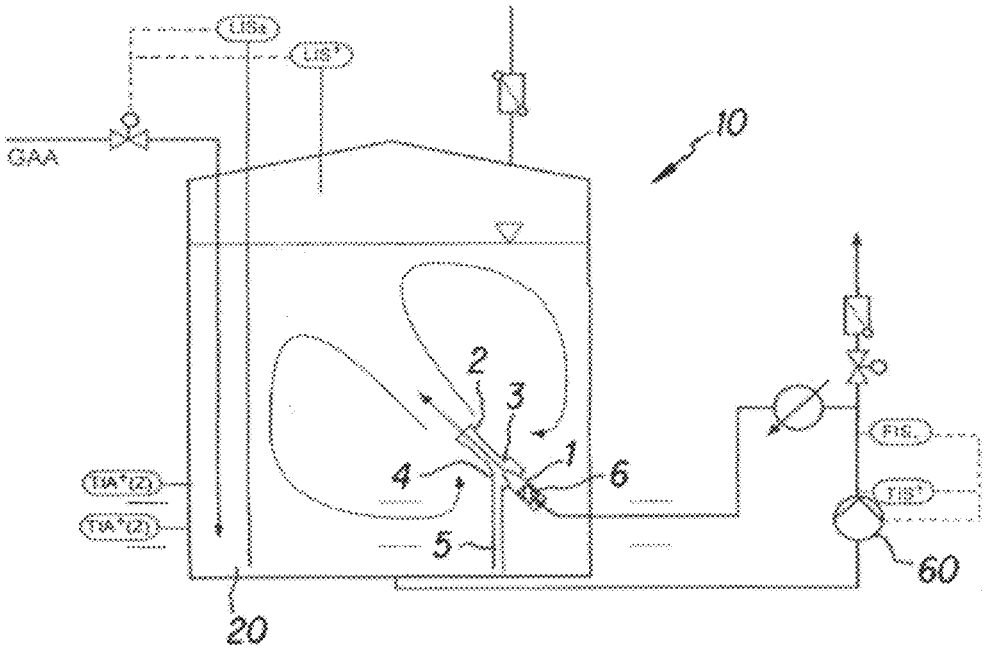
FIG. 13 is a schematic depiction of an exemplary vessel for storing a liquid or a mixture of a liquid and a fine solid according to the present invention.

In addition, the abbreviations in FIGS. 10 and 13 stand for:

$TIA^+$ for "temperature indicator alarm";

LIS for "level indicator switch"; as overfill protection (+) and as underfill protection (–);

$TIS^+$ for "temperature indicator security";

FIS for "flow indicator security";

F for "flow" (small safety flow as pump protection);

Z for "SIL3 interlock".

In addition, FIGS. 10 and 13 show, on the vessel roof, a two-way non-return valve and, beyond the pump but upstream of the withdrawal, a single-action (only opening outward) non-return valve.

With regard to the abovementioned teachings, numerous changes and deviations from the present invention are possible. It can therefore be assumed that the invention, within the scope of the appended claims, can be performed differently from the way described specifically herein.

The invention claimed is:

1. A process for mixing a liquid or mixture of a liquid and a fine solid present in an essentially self-contained storage tank, the process comprising:

supplying essentially the same liquid or mixture into the storage tank as a stream that flows into a jet nozzle that is disposed in the liquid or mixture;

wherein:

the storage tank has an internal volume V, the liquid or mixture fills only part of the internal volume V, and a remainder of the internal volume V is occupied by a gas phase;

the jet nozzle comprises a motive nozzle and a momentum exchange chamber into which the stream flows after leaving the motive nozzle and before entering a remainder of the storage tank;

a suction region of the jet nozzle, where the motive nozzle directs the liquid or mixture into the momentum exchange chamber, is provided with a sheath having at least one suction orifice;

the at least one suction orifice is provided below the stream as the stream passes through the jet nozzle; and passage of the stream out of the motive nozzle and into the momentum exchange chamber causes the liquid or the mixture stored in the storage tank to be drawn into the at least one suction orifice.

2. The process according to claim 1, wherein the at least one suction orifice is configured as at least one immersed tube which opens out from the sheath toward the storage tank bottom.

3. The process according to claim 1, wherein a swirling motion is imparted to the stream before it passes through the motive nozzle.

4. The process according to claim 3, wherein the swirling motion is imparted with a swirl body installed upstream of the motive nozzle.

5. The process according to claim 3, wherein the swirling motion is imparted by supplying the stream to the motive nozzle tangentially.

6. The process according to claim 1, wherein the stream is divided as it passes through the motive nozzle.

7. The process according to claim 6, wherein the motive nozzle is a screen nozzle or a slot nozzle.

8. The process according claim 1, wherein the liquid comprises at least one organic compound selected from the group consisting of acrolein, methacrolein, acrylic acid, methacrylic acid, esters of acrylic acid and esters of methacrylic acid.

9. The process according to claim 1, wherein the liquid comprises N-vinylformamide.

10. The process according to claim 1, wherein the liquid comprises at least one dissolved polymerization inhibitor.

11. The process according to claim 1, wherein the gas phase comprises molecular oxygen.

12. The process according to claim 1, wherein at least a portion of stream comprises liquid or mixture previously withdrawn from the storage tank.

13. The process according to claim 1, wherein the stream is free from liquid or mixture previously withdrawn from the storage tank.

14. The process according to claim 1, wherein the stream comprises liquid or mixture that has been conducted through a heat exchanger before entering the storage tank.

15. The process according to claim 1, wherein at least $10^{-5}$ liter per minute per liter of liquid flows through the momentum exchange chamber.

16. The process according to claim 1, wherein at least $10^{-5}$ liter per minute per liter of mixture flows through the momentum exchange chamber.

17. A process for mixing a first liquid or mixture of a liquid and a fine solid into a second liquid or mixture of a liquid and a fine solid present in an essentially self-contained storage tank, the process comprising:

supplying the first liquid or mixture into the storage tank as a stream that flows into a jet nozzle disposed in the second liquid or mixture;

wherein:

the storage tank has an internal volume V, the liquid or mixture fills only part of the internal volume V, and a remainder of the internal volume V is occupied by a gas phase;

the jet nozzle comprises a motive nozzle and a momentum exchange chamber into which the stream flows after leaving the motive nozzle and before entering a remainder of the storage tank;

a suction region of the jet nozzle, where the motive nozzle directs the liquid or mixture into the momentum exchange chamber, is provided with a sheath having at least one suction orifice;

the at least one suction orifice is provided below the stream as the stream passes through the jet nozzle; and passage of the stream out of the motive nozzle and into the momentum exchange chamber causes the liquid or the mixture stored in the storage tank to be drawn into the at least one suction orifice.

18. The process according to claim 17, wherein:

the second liquid comprises a compound having at least one ethylenically unsaturated moiety; and the first liquid comprises an inhibitor solution comprising at least 10% by weight of phenothiazine, from 5 to 10% by weight of p-methoxy-phenol and at least 50% by weight of N-methylpyrrolidone.

* * * * *